US006802420B2

(12) United States Patent
Fukugawa et al.

(10) Patent No.: US 6,802,420 B2
(45) Date of Patent: Oct. 12, 2004

(54) PHOTOSENSITIVE MATERIAL ROLL

(75) Inventors: Masafumi Fukugawa, Kanagawa (JP); Nobuhiko Kashiwagi, Kanagawa (JP); Taisuke Nakanishi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 155 days.

(21) Appl. No.: 10/140,992

(22) Filed: May 9, 2002

(65) Prior Publication Data

US 2002/0170996 A1 Nov. 21, 2002

(30) Foreign Application Priority Data

May 15, 2001 (JP) ..... 2001-145316

(51) Int. Cl.[7] ..... B65D 85/66
(52) U.S. Cl. ..... 206/410; 206/413
(58) Field of Search ..... 206/389, 399, 206/400, 401, 402, 410, 411, 412, 413, 414, 415, 416, 455

(56) References Cited

U.S. PATENT DOCUMENTS 4,516,892 A * 5/1985 Curro, Jr. ..... 410/155
4,733,777 A 3/1988 Van Geyte et al.
6,481,904 B2 * 11/2002 Fukugawa et al. ..... 396/513
6,619,478 B2 * 9/2003 Fukugawa et al. ..... 206/410

FOREIGN PATENT DOCUMENTS

JP 2001-318451 11/2001

OTHER PUBLICATIONS

U.S.S.N. 09/745,868, Q62444, Filed Dec. 26, 2000.

* cited by examiner

*Primary Examiner*—Shian T. Luong
(74) *Attorney, Agent, or Firm*—Sughrue Mion, PLLC

(57) ABSTRACT

A light-shielded photosensitive material roll equipped with adapters is provided in which a photosensitive material sheet, which has been unwound once, can be wound up again smoothly. The photosensitive material roll, which can be mounted in a predetermined machine, includes: (a) a hollow, cylindrical winding core; (b) an elongated photosensitive material sheet wound-up on the winding core; (c) an annular member including a cylindrical portion inserted in an opening of the core, and a flange portion extending in a radial direction from one end of the cylindrical portion; (d) a ring-shaped light-shielding sheet disposed between the annular member flange portion and the core; and (e) an adapter including an adapter tube portion inserted into the annular member cylindrical portion, and an adapter flange portion extending in a radial direction from one end of the adapter tube portion. The light-shielding sheet is partially adhered to the adapter flange portion.

10 Claims, 11 Drawing Sheets

PHOTOSENSITIVE MATERIAL ROLL

BACKGROUND OF THE INVENTION

1. Field of the Invention

The present invention relates to a light-shielded photosensitive material roll which, in a lighted room, is loaded into a plate making machine using a photosensitive material.

2. Description of the Related Art

An elongated photosensitive material sheet is, in a state of being wound-up in a roll form on a winding core, loaded into a plate making machine which uses a photosensitive material. Usually, the side surfaces of the photosensitive material roll are covered by ring-shaped light-shielding sheets and the periphery of the photosensitive material roll is covered by a light-shielding leader so that the photosensitive material roll can be loaded into the plate making machine in a lighted room. (Hereinafter, a photosensitive material roll which is covered by light-shielding members is called a light-shielded photosensitive material roll.)

A light-shielded photosensitive material roll is usually supported within a plate making machine by a driving shaft which is inserted into the winding core. The diameter of the driving shaft differs in accordance with the type of the plate making machine. Thus, a method is employed in which light-shielding flanged adapters, which have inner diameters which correspond to the driving shafts of various types of plate making machines, are installed at the winding core of the light-shielded photosensitive material roll. The development of adapters for light-shielded photosensitive material rolls has advanced.

Japanese Patent Application Laid-Open (JP-A) No. 2000-181018 proposes an adapter in which a rolling body (an O-ring), which is an elastic body, is disposed at the outer side surface of the tube portion of the adapter which is inserted into the winding core. In accordance with the structure disclosed in JP-A No. 2000-181018, this adapter which is equipped with the rolling body can be securely fixed to the winding core of the light-shielded photosensitive material roll. Further, attachment and removal of the adapter to and from the light-shielded photosensitive material roll is easy.

Moreover, the applicant of the present application has found that, by providing a convex portion, which extends along the lengthwise direction of the tube portion of the adapter, at the outer side surface of the tube portion of the adapter, and by engaging this convex portion of the adapter with a groove which is provided in the winding core of the light-shielded photosensitive material roll and extends along the lengthwise direction thereof, the adapter can be securely installed in the winding core of the light-shielded photosensitive material roll. The present applicant has filed a patent application for an invention based on this finding (see JP-A No. 2001-318451).

It is desirable that the light-shielded photosensitive material roll is a structure that enables a photosensitive material sheet, which has been unwound once, to be smoothly wound up again onto the winding core. However, research conducted by the present inventors has shown that, in a light-shielded photosensitive material roll equipped with adapters, a ring-shaped light-shielding sheet easily slants toward the photosensitive material roll (toward the side opposite the adapter flange) at the time when the photosensitive material sheet is being unwound. When the photosensitive material sheet, which has been unwound from the photosensitive material roll, is wound up again onto the winding core of the original photosensitive material roll, the side end portion of the photosensitive material may contact the surface of the peripheral end portion of the ring-shaped light-shielding sheet, which may cause offset in the winding of the photosensitive material sheet. When such winding offset of the photosensitive material sheet occurs within a plate making machine, the photosensitive material roll must be removed from the plate making machine, and the photosensitive material sheet is exposed and cannot be used. In addition, winding offset is a cause of malfunctioning of the plate making machine.

SUMMARY OF THE INVENTION

An object of the present invention is to overcome the above-described problems.

In order to achieve this object, in accordance with an aspect of the present invention, there is provided a photosensitive material roll which can be mounted in a predetermined machine, comprising: (a) a hollow, cylindrical winding core; (b) an elongated photosensitive material sheet wound-up on the winding core; (c) an annular member including a cylindrical portion inserted in an opening of the winding core, and a flange portion extending in a radial direction from one end of the cylindrical portion; (d) a ring-shaped light-shielding sheet disposed between the flange portion of the annular member and the winding core; and (e) an adapter including an adapter tube portion inserted into the cylindrical portion of the annular member, and an adapter flange portion extending in a radial direction from one end of the adapter tube portion, wherein the ring-shaped light-shielding sheet is partially adhered to the adapter flange portion.

In accordance with another aspect of the present invention, there is provided a photosensitive material roll which can be mounted in a predetermined machine, comprising: (a) a hollow, cylindrical winding core; (b) an elongated photosensitive material sheet wound-up on the winding core; (c) a ring-shaped light-shielding sheet including a cylindrical portion inserted in an opening of the winding core, and a ring-shaped sheet portion extending in a radial direction from one end of the cylindrical portion; and (d) an adapter including an adapter tube portion inserted into the cylindrical portion of the ring-shaped light-shielding sheet, and an adapter flange portion extending in a radial direction from one end of the adapter tube portion, wherein the adapter flange portion includes a ring-shaped recess which can receive an outer peripheral portion of the ring-shaped sheet portion of the ring-shaped light-shielding sheet, the recess being formed at a position of the adapter flange portion which position corresponds to the outer peripheral portion of the ring-shaped sheet portion.

DESCRIPTION OF THE PREFERRED EMBODIMENTS

The structure of a light-shielded photosensitive material roll equipped with adapters of the present invention, and the main structural members thereof will be described hereinafter with reference to the appended drawings.

Figure 1:
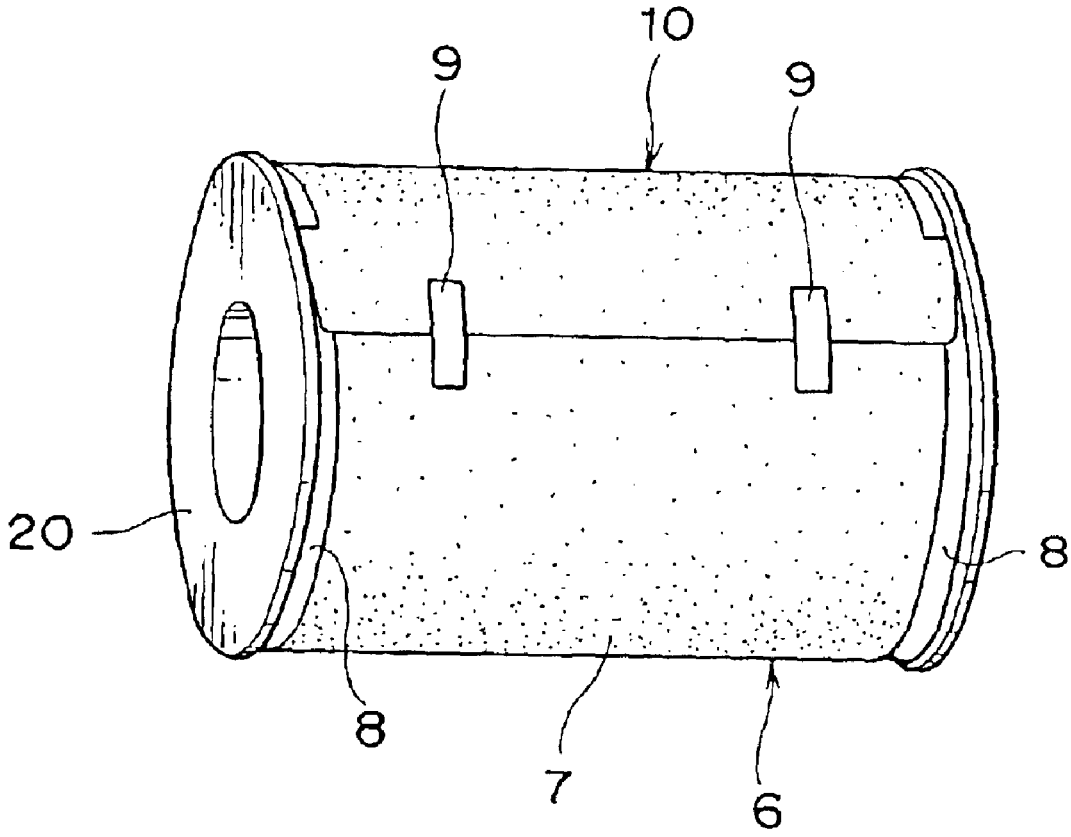
FIG. 1 is a perspective view of an example of a light-shielded photosensitive material roll equipped with adapters of the present invention.
Figure 2:
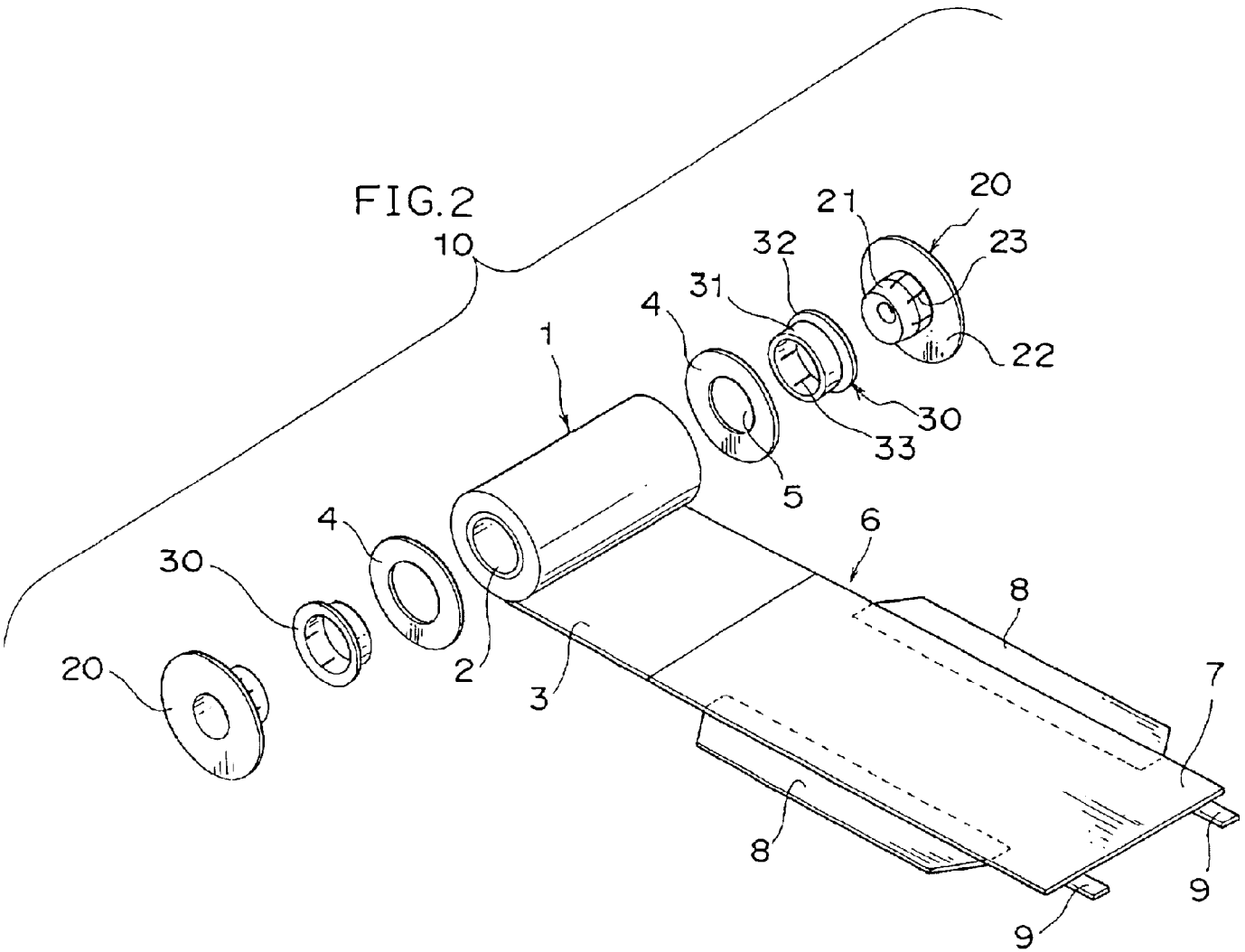
FIG. 2 is an exploded perspective view of the light-shielded photosensitive material roll equipped with adapters of FIG. 1.

FIG. 1 is a perspective view of an example of a light-shielded photosensitive material roll equipped with adapters of the present invention. FIG. 2 is an exploded perspective view of the light-shielded photosensitive material roll equipped with adapters of FIG. 1. The light-shielded photosensitive material roll equipped with adapters is formed from a light-shielded photosensitive material roll 10, and light-shielding flanged adapters 20 which are inserted into the both open end portions of a winding core of the light-shielded photosensitive material roll 10. The adapter 20 is formed from a tube portion 21 and an adapter flange portion 22. Convex portions 23, which extend along the lengthwise direction of the tube portion 21, are provided at the outer side surface of the tube portion 21.

An elongated photosensitive material sheet 3 is wound around the periphery of a winding core 2 of the photosensitive material roll 1.

Examples of the photosensitive material sheet 3 are photosensitive materials for printing (photosensitive material films or paper for photographic plate making or photocomposition) and photosensitive materials for photographic printing paper (color paper or black-and-white photographic printing paper). Specific examples of photosensitive materials for printing are camera film, contact film, stripping film, duplicating film, laser film, camera paper, contact paper, stripping paper, duplicating paper, laser paper, dry facsimile film, lith film, and gravure film. Specific examples of photosensitive materials for photographic printing paper are color paper, color laser paper, reversal color paper, chrome paper, photographic printing paper for close contact, photographic printing paper for enlargement, multi-gradation photographic printing paper for enlargement, and photographic printing paper for special purposes.

The thickness of the winding core 2 is usually in the range of 1 to 5 mm. Usually, a paper tube is used for winding core 2. However, a plastic tube formed from a resin such as polystyrene or the like, or a metal tube formed from a metal such as aluminum or the like, may be used for the winding core 2. A buffer sheet (cushion sheet), which is a polyethylene-laminated paper or a foamed urethane sheet or the like, may be wound around the outer side surface of the winding core 2 such that traces of the pushing by the winding core are not pressed into the photosensitive material sheet which contacts the winding core.

The light-shielded photosensitive material roll 10 is formed from the photosensitive material roll 1, ring-shaped side surface light-shielding sheets 4 which are mounted to the end portions of the winding core 2, and a light-shielding leader 6 joined to the distal end portion of the elongated photosensitive material sheet 3 and wound around the periphery thereof. The final end of the light-shielding leader 6, which is wound on the periphery of the photosensitive material roll, is fastened by adhesive tapes 9.

The radius of the ring-shaped side surface light-shielding sheet 4 is substantially equal to the radius of the photosensitive material roll 1. Usually, the radius of the ring-shaped side surface light-shielding sheet 4 is the same as the radius of the photosensitive material roll or is slightly smaller than the radius of the photosensitive material roll. The diameter of a circular hole 5, which is provided in the center of the ring-shaped side surface light-shielding sheet 4, is larger than the inner diameter of the winding core 2 and smaller than the outer diameter of the winding core 2. The thickness of the ring-shaped side surface light-shielding sheet 4 is usually in a range of 0.1 to 0.5 mm. The rigidity of the ring-shaped side surface light-shielding sheet 4 is preferably within a range of 30 to 150 [$(cm)^3$], as a value measured in accordance with the Clark method stipulated in JIS-P-8143 (Method of Testing Stiffness of Paper by Deadweight Bending Method).

The ring-shaped side surface light-shielding sheet 4 can be mounted to the winding core 2 by, as shown in FIG. 2 for example, a cylindrical portion 31 of a flanged cylinder 30 having a flange portion 32 being passed through the circular hole 5 of the ring-shaped side surface light-shielding sheet 4 and inserted into and fixed in the winding core 2.

A resin such as polyethylene, polyethylene terephthalate, polycarbonate, polystyrene (in particular, shock-resistant polystyrene), polyester, polypropylene or the like in which a light-shielding powder such as carbon black or the like is dispersed within a range of 1 to 10% by weight, can be used as the material of the ring-shaped side surface light-shielding sheet 4.

The ring-shaped side surface light-shielding sheet 4 may be a single-layer sheet formed from the aforementioned resin materials, but is preferably a layered sheet in which two or more films formed from the aforementioned resin materials are layered. An example of a layered sheet for the ring-shaped side surface light-shielding sheet is a layered sheet having a three-layer structure of polyethylene film (thickness: 20 to 40 $\mu$m)/polyethylene terephthalate film (thickness: 25 to 100 $\mu$m)/polyethylene film (thickness: 20 to 40 $\mu$m). Further, when the ring-shaped side surface light-shielding sheet and the flange portion 32 of the flanged cylinder 30 are heat-fused, a layered sheet, which has on one surface thereof a low-temperature heat sealable film (e.g., an ethylene-vinyl acetate copolymer film) can also be used. Specific examples of layered sheets having a low-temperature heat sealable film are a layered sheet having a four-layer structure in which an ethylene-vinyl acetate copolymer film is adhered onto one surface of the above-described layered sheet having a three-layer structure, and a layered sheet having a three-layer structure in which one of the polyethylene films of the above-described layered sheet having a three-layer structure is replaced with an ethylene-vinyl acetate copolymer film. In a ring-shaped side surface light-shielding sheet having a low-temperature heat sealable film on one surface thereof, it is preferable to color code the low temperature heat sealable film surface and the other surface such that they can be visually distinguished from one another. For example, the low temperature heat sealable film surface may be made to be black, and the other surface may be made to be gray, or the like.

Any of various types of laminating methods (e.g., a dry laminating method) may be used to laminate the films.

Figure 3:
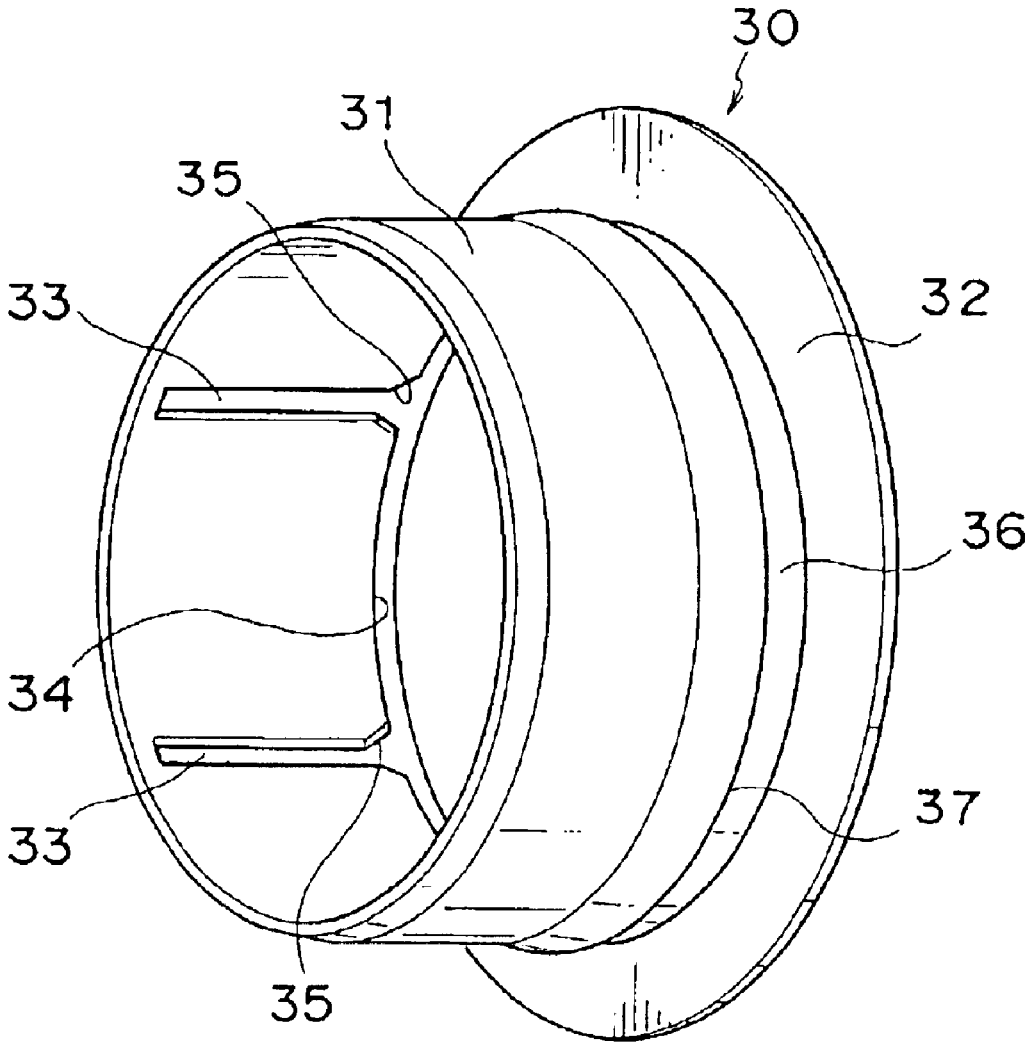
FIG. 3 is a perspective view of an example of a flanged cylinder which can be suitably used in the light-shielded photosensitive material roll equipped with adapters of the present invention.
Figure 4:
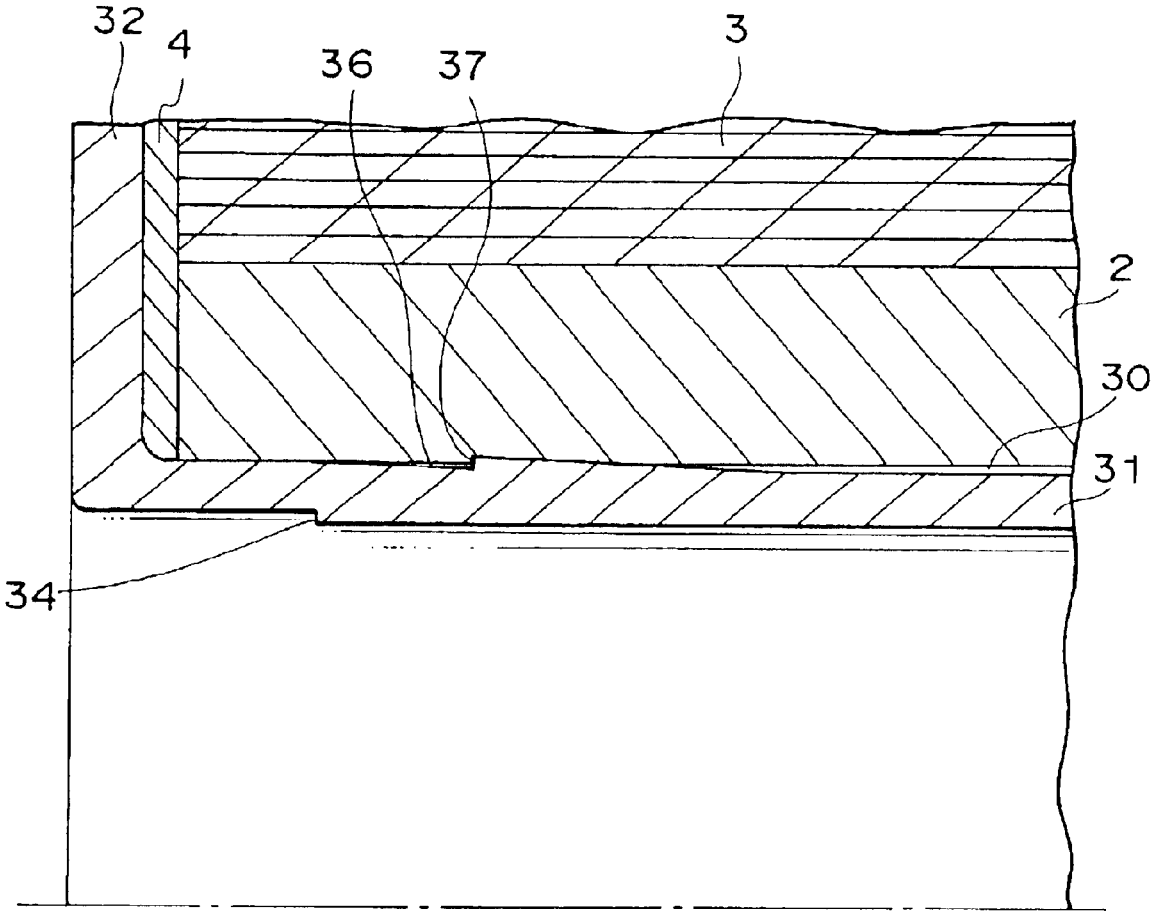
FIG. 4 is a partial sectional view of a light-shielded photosensitive material roll using the flanged cylinder of FIG. 3.

FIG. 3 is a perspective view showing an example of a flanged cylinder which can be suitably used in the light-shielded photosensitive material roll equipped with adapters of the present invention. FIG. 4 is a partial sectional view of a light-shielded photosensitive material roll using the flanged cylinder of FIG. 3. Grooves 33, which extend in the lengthwise direction, are formed in the inner wall of the cylindrical portion 31 of the flanged cylinder 30, at positions corresponding to the convex portions 23 formed at the outer side surface of the tube portion 21 of the adapter 20. By engaging the grooves 33 of the flanged cylinder 30 and the convex portions 23 of the adapter 20, the adapter can be strongly installed with respect to the rotating direction of the light-shielded photosensitive material roll, such that the adapter does not run idly. A step 34 is provided at the inner wall of the cylindrical portion 31 at the periphery of the flange side end portion. An inclined step 35, which extends at an incline from the groove 33 to the step 34, is also provided at the inner wall of the cylindrical portion 31. The step 34 and the inclined step 35 function to facilitate insertion of the adapter 20 into the cylindrical portion 31 of the flanged cylinder 30. Namely, if the adapter 20 is inserted into the cylindrical portion 31 of the flanged cylinder 30 while the adapter 20 is rotated, the distal end surfaces of the convex portions 23 of the adapter contact the step 34, pass along the inclined steps 35, and reach the grooves 33. Thus, fitting-together of the convex portions 23 and the grooves 33 is easy.

The outer diameter of the cylindrical portion 31 of the flanged cylinder 30 is preferably 100.1 to 103% of the inner diameter of the winding core. Further, it is preferable to provide a tube portion recess portion 36 at the flange side of the outer side surface of the cylindrical portion. By making the outer diameter of the cylindrical portion 31 to be greater than the inner diameter of the winding core, and by providing the tube portion recess portion 36, as shown in FIG. 4, the cylindrical portion 31 of the flanged cylinder 30 bends inwardly at the tube portion recess portion 36. A projection 37 of the tube portion recess portion 36 strongly contacts the inner wall of the winding core 2, such that the integration of the flanged cylinder 30 and the winding core 2 is strengthened.

A resin such as polycarbonate, polystyrene (in particular, shock-resistant polystyrene), polyester, polypropylene or the like in which a light-shielding powder such as carbon black or the like is dispersed within a range of 1 to 10% by weight, can be used as the material of the flanged cylinder 30.

The light-shielding leader 6 is usually wound onto the periphery of the photosensitive material roll after the ring-shaped side surface light-shielding sheets 4 have been attached to the winding core 2. The length of the light-shielding leader 6 is greater than or equal to the outer circumference of the photosensitive material roll 1, and is usually two to three times the outer circumference of the ring-shaped side surface light-shielding sheet. The width of the light-shielding leader 6 is wider than the width of the photosensitive material roll, to the extent that both end portions of the light-shielding leader 6 contact the outer side surfaces of the ring-shaped side surface light-shielding sheets.

In the method of making the both end portions of the light-shielding leader 6 contact the outer side surfaces of the ring-shaped side surface light-shielding sheets 4, it is preferable to use a method in which a heat shrinkable light-shielding sheet is used as the light-shielding leader, and the heat shrinkable light-shielding sheet is heat shrunk. When a heat shrinkable light-shielding sheet is used as the light-shielding leader, the entire light-shielding leader may be a heat shrinkable light-shielding sheet. However, using heat shrinkable light-shielding sheets only at the portions which contact the outer side surfaces of the ring-shaped side surface light-shielding sheets is preferable from the standpoint of costs for materials.

The light-shielding leader 6 shown in FIG. 2 is a structure in which heat shrinkable light-shielding sheets 8 are attached to both side end portions of a light-shielding sheet 7 which has the same width as the photosensitive material sheet and which hardly heat shrinks or does not heat shrink at all.

A resin such as low-density polyethylene, polyethylene terephthalate or the like, in which a light-shielding pigment such as carbon black or the like has been mixed in, can be used as the material of the light-shielding sheet 7. The light-shielding sheet may be a single layer sheet formed from the aforementioned resin materials. However, the light-shielding sheet is preferably a layered sheet in which two or more films formed from the aforementioned resin materials are layered. An example of a layered sheet for the light-shielding sheet is a layered sheet having a three-layer structure of polyethylene film/polyethylene terephthalate film/polyethylene film. It is preferable that the thickness of the polyethylene film is within the range of 20 to 100 $\mu$m, and that the thickness of the polyethylene terephthalate film is within the range of 25 to 175 $\mu$m. Any of various types of laminating methods (e.g., a dry laminating method) may be used to laminate the films.

It is preferable that the heat shrinkage rate in the lengthwise direction of the heat shrinkable light-shielding sheet 8 is relatively larger than the heat shrinkage rate in the widthwise direction. For example, the heat shrinkage rate in the lengthwise direction of the heat shrinkable light-shielding film at 100° C. is 5% or more, and preferably 15% or more, and, as an absolute difference, is 1% or more greater, and preferably 3% or more greater, and more preferably 5% or more greater than the heat shrinkage rate in the widthwise direction. Note that the heat shrinkage rate of the heat shrinkable light-shielding film is a value measured in accordance with the method stipulated in JIS-Z-1709:1976 (Film for Shrink Packaging).

The heat shrinkable light-shielding sheet 8 is preferably tearable in the lengthwise direction. More preferably, the Elmendorf tearing load in the lengthwise direction is within the range of 0.1 to 0.5 N. If the Elmendorf tearing load in the lengthwise direction is greater than 0.5 N, the heat shrinkable light-shielding sheet tends to become difficult to tear. Further, if the Elmendorf tearing load is less than 0.1 N, the heat shrinkable light-shielding film tends to become easy to tear during transport of the light-shielded photosensitive material roll. Note that the Elmendorf tearing load of the heat shrinkable light-shielding film is a value measured in accordance with the method stipulated in JIS-K-7128-2:1998 (Method of Testing Tear Strength of Plastic Film and Sheet: Part 2).

A layered sheet, in which a transparent or semi-transparent shrink film which has high heat shrinkability in the lengthwise direction and which is tearable in the lengthwise direction, and a light-shielding film which barely exhibits heat shrinkability or does not exhibit any heat shrinkability at all, are laminated, may be used as the heat shrinkable light-shielding sheet 8. In particular, a layered sheet having a three-layer structure of the light-shielding film/shrink film/light-shielding film is preferable. The thickness of each of the light-shielding films and shrink film is preferably in a range of 10 to 30 $\mu$m. For example, Fancy Wrap (trade name, manufactured by Gunze Ltd.) having a grade of THS, TNS, TAS, TBS, or TRS can be used as the shrink film. A film, such as, for example, a low-density polyethylene film or the like into which a pigment such as carbon black or the like has been mixed in, can be used as the light-shielding film.

Figure 5:
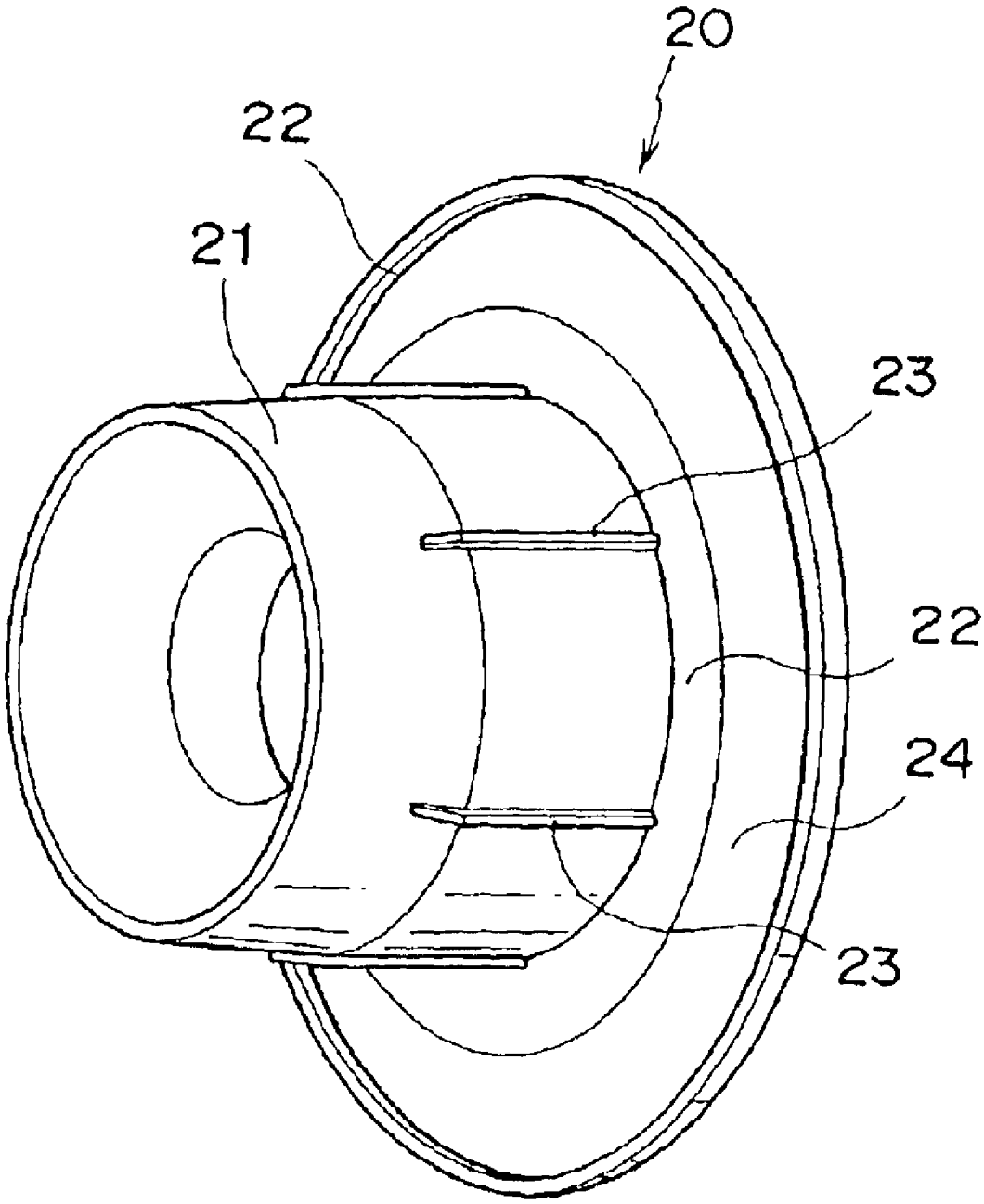
FIG. 5 is a perspective view of an example of an adapter which can be suitably used with the light-shielded photosensitive material roll equipped with adapters of the present invention.
Figure 6:
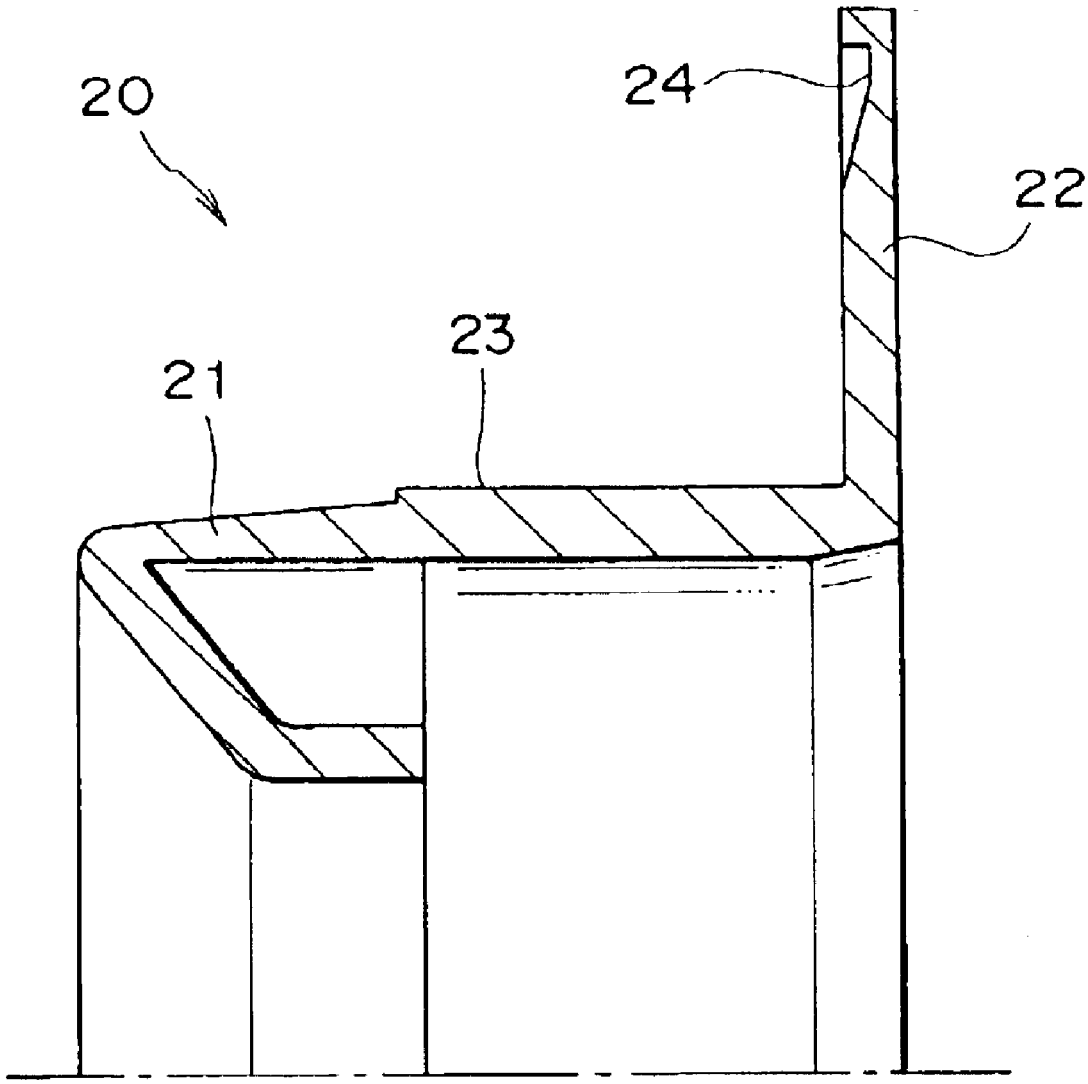
FIG. 6 is a sectional view of the adapter of FIG. 5.

FIG. 5 is a perspective view of an example of an adapter which can be suitably used with the light-shielded photosensitive material roll equipped with adapters of the present invention. FIG. 6 is a sectional view of the adapter of FIG. 5.

A ring-shaped flange recess portion 24 is formed in the adapter flange portion 22 at a portion contacted by the peripheral portion of the ring-shaped side surface light-shielding sheet. The flange recess portion 24 is inclined toward the adapter tube portion 21. The surface of the portion of the adapter flange portion 22 where the flange recess portion 24 is not provided, which portion contacts the ring-shaped side surface light-shielding sheet 4, is preferably reduced by an amount corresponding to the thickness of the ring-shaped side surface light-shielding sheet.

A resin such as polycarbonate, polystyrene (in particular, shock-resistant polystyrene), polyester, polypropylene or the like in which a light-shielding powder such as carbon black or the like is dispersed within a range of 1 to 10% by weight, can be used as the material of the adapter 20.

Figure 7:
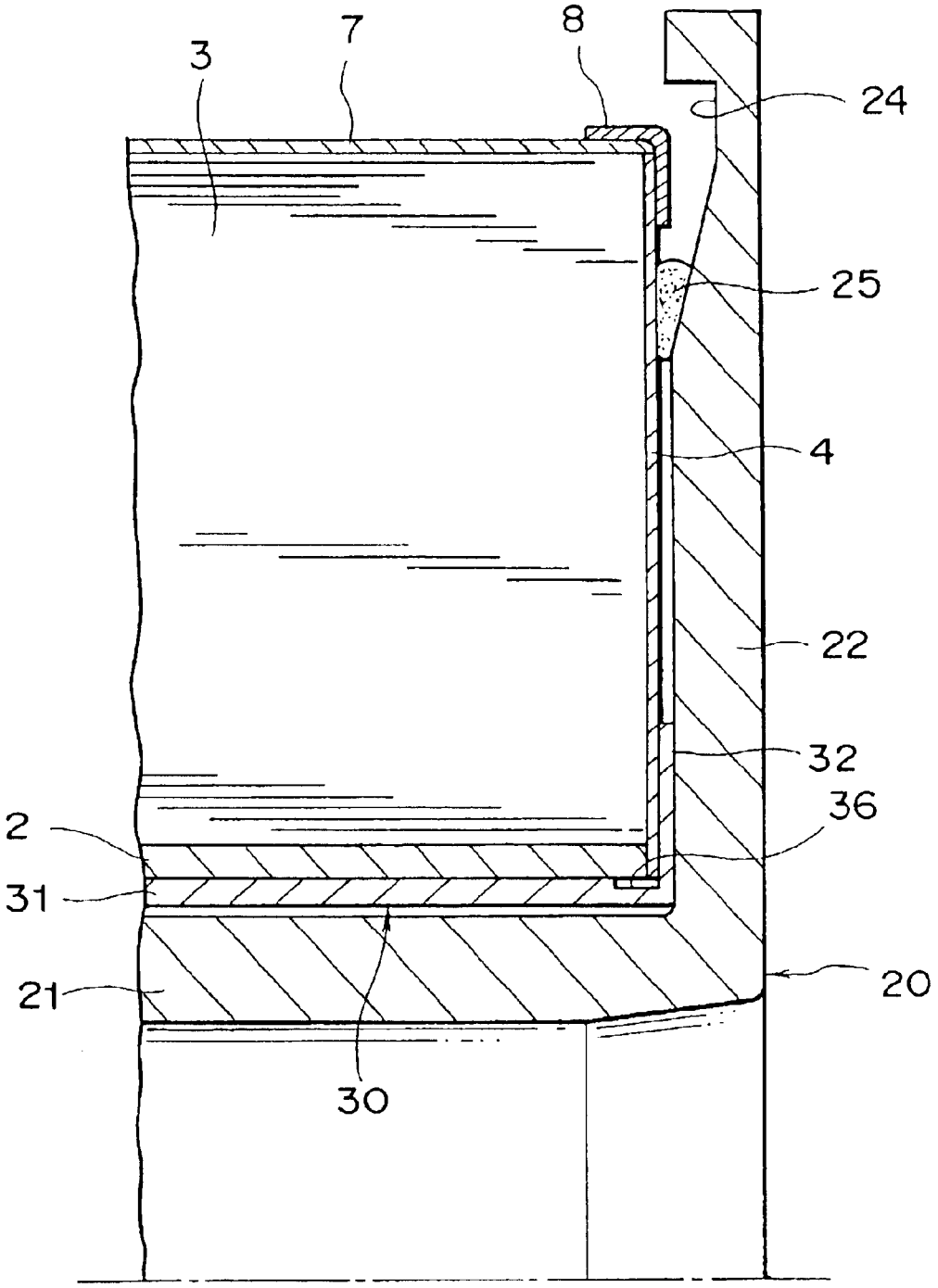
FIG. 7 is a partial sectional view of an example of the light-shielded photosensitive material roll equipped with adapters of the present invention.

FIG. 7 is a sectional view of an example of the light-shielded photosensitive material roll equipped with adapters of the present invention. The ring-shaped side surface light-shielding sheet 4 is adhered and fixed to the inner side wall of the adapter flange portion 22 of the adapter 20 by an adhesive 25. The adhesive 25 may be applied to the ring-shaped side surface light-shielding sheet 4. However, usually, the adhesive 25 is applied to the adapter flange portion 22 of the adapter 20. In FIG. 7, the adhesive 25 is applied to the adapter tube portion 21 side end portion of the flange recess portion 24. However, the position at which the adhesive is applied is not limited to the same. The adhesive 25 is preferably applied to width of 5 to 20 mm.

Any of various types of pressure-sensitive adhesives such as hot-melt-type pressure-sensitive adhesives (e.g., adhesives using, as the base polymer, ethylene-vinyl acetate copolymer, a block copolymer of styrene butadiene or styrene-isoprene or the like, polyamide, or acrylester copolymer), emulsion-type pressure-sensitive adhesives (e.g., acrylic emulsion), rubber-type pressure-sensitive adhesives (e.g., natural rubber, isoprene rubber, reclaimed rubber, styrene butadiene rubber), or the like, may be used as the adhesive 25. Among these pressure-sensitive adhesives, hot-melt-type pressure-sensitive adhesives are preferable, and hot-melt-type pressure-sensitive adhesives which solidify at room temperature are particularly preferable. An example of a commercially available hot-melt-type pressure-sensitive adhesive which solidifies at room temperature is the room temperature adhering Nit-Tight HT-400Q manufactured by Nitta Gelatin Inc.

When the hot-melt-type pressure-sensitive adhesive is applied to the adapter, it is preferable to apply the adhesive by using a nozzle-type hot-melt applicator while rotating the adapter on a rotating table. Any of dot-type, bead-type, coating-type, spiral-type, or the like, nozzles can be used as the nozzle of the applicator. Usually, a bead-type or a spiral-type nozzle is used. A hot-melt applicator manufactured by Nordson KK, for example, may be used as the applicator.

Instead of an adhesive, double-sided tape may be used to adhere and fix the ring-shaped side surface light-shielding sheet 4 and the adapter flange portion 22 of the adapter 20.

Figure 8:
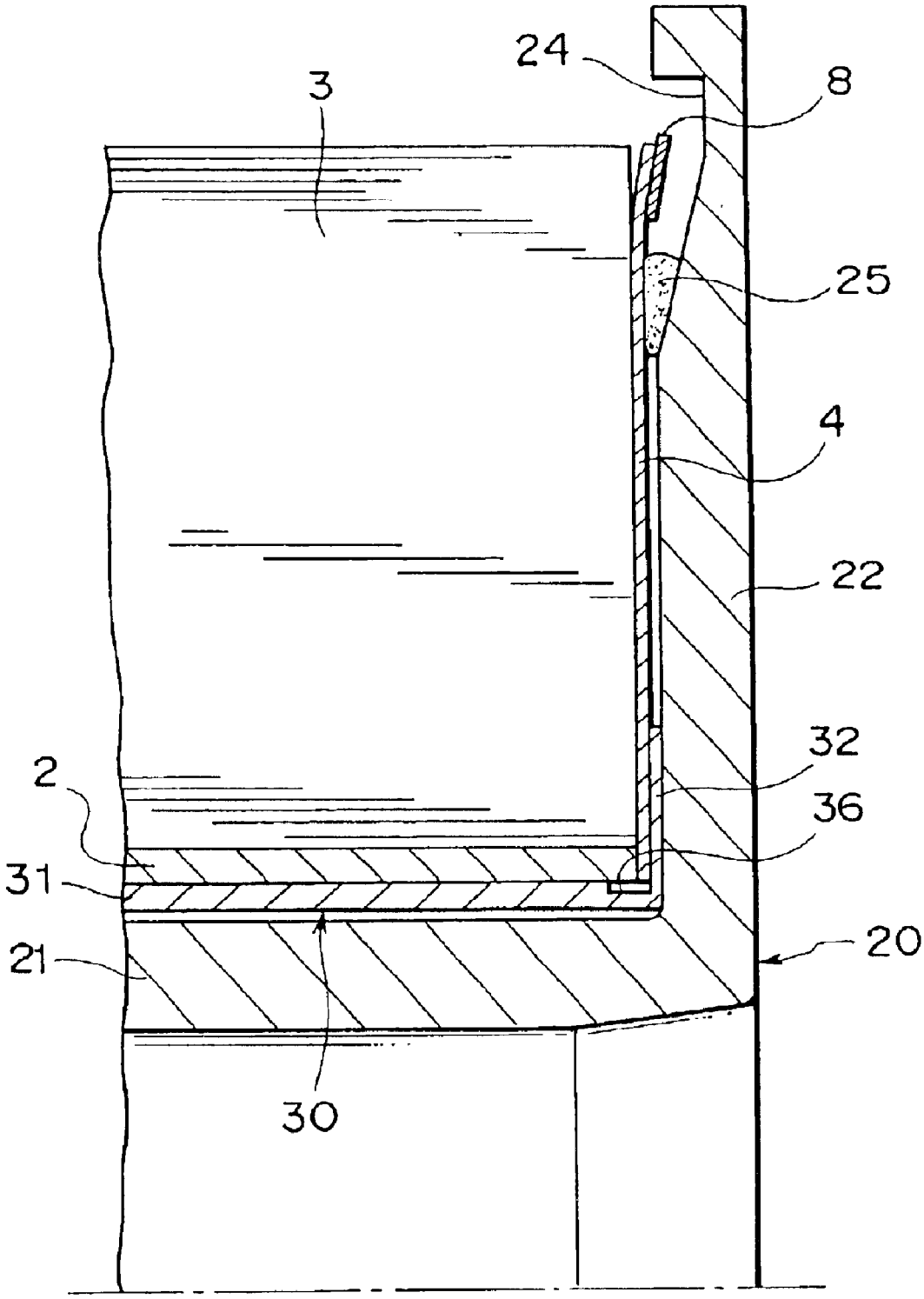
FIG. 8 is a diagram showing a state in which a portion of a photosensitive material sheet has been unwound from the light-shielded photosensitive material roll equipped with adapters of FIG. 7.

FIG. 8 is a diagram showing a state in which a portion of the photosensitive material sheet has been unwound from the light-shielded photosensitive material roll equipped with adapters of FIG. 7. The heat shrinkable light-shielding sheet 8 portions of the light-shielding leader 6 are torn. The ring-shaped side surface light-shielding sheet 4 is adhered and fixed in a state in which the peripheral portion thereof is accommodated in the recess portion 24 of the adapter flange portion 22. Accordingly, in this state, even if the photosensitive material sheet is wound up again onto the winding core, it is difficult for the peripheral portion of the ring-shaped side surface light-shielding sheet 4 and the side end portion of the photosensitive material sheet 3 to contact one another.

In the light-shielded photosensitive material roll equipped with adapters which is shown in FIGS. 7 and 8, the ring-shaped side surface light-shielding sheet 4 is adhered and fixed to the inner side surface of the flange portion 22 of the adapter 20. However, if the peripheral portion of the ring-shaped side surface light-shielding sheet 4 is accommodated in the flange recess portion 24 of the flange portion of the adapter when the photosensitive material 3 is unwound from the light-shielded photosensitive material roll, there are cases in which it suffices to not adhere and fix the ring-shaped side surface light-shielding sheet 4 to the inner side surface of the flange portion 22 of the adapter 20.

As a method of accommodating the peripheral portion of ring-shaped side surface light-shielding sheet within the flange recess portion without adhering and fixing the ring-shaped side surface light-shielding sheet to the inner side surface of the flange portion of the adapter, there is a method using a ring-shaped side surface light-shielding sheet which is formed in a ring-shaped configuration having a cylindrical portion at the center thereof, and which, in a state of not being restrained (i.e., in a state in which it does not contact the end portion of the light-shielding leader), inclines in the direction toward the side opposite the cylindrical portion from the center toward the peripheral portion thereof.

Figure 9:
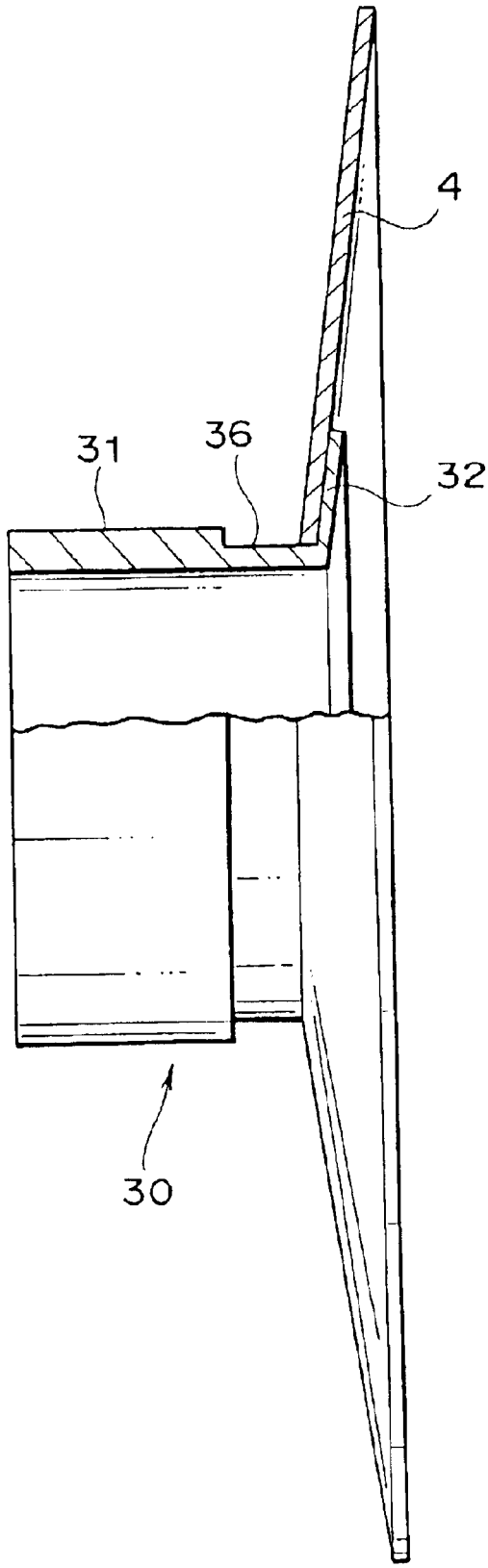
FIG. 9 is a side view, from which a portion has been removed, of an example of an inclined ring-shaped side surface light-shielding sheet of the present invention.

FIG. 9 is a side view, from which a portion has been removed, of an example of an inclined ring-shaped side surface light-shielding sheet. In FIG. 9, the inclined ring-shaped side surface light-shielding sheet is formed from the flanged cylinder 30 and the ring-shaped side surface light-shielding sheet 4. The flange portion 32 of the flanged cylinder 30 and the ring-shaped side surface light-shielding sheet 4 are respectively inclined in the direction toward the side opposite the cylindrical portion (i.e., toward the flange portion side of the adapter 20) from the centers toward the peripheral portions thereof. The angle of inclination is preferably 5 to 20° with respect to the surface of the flange portion of the adapter which is inserted into the cylindrical portion 31 of the flanged cylinder 30.

Figure 10:
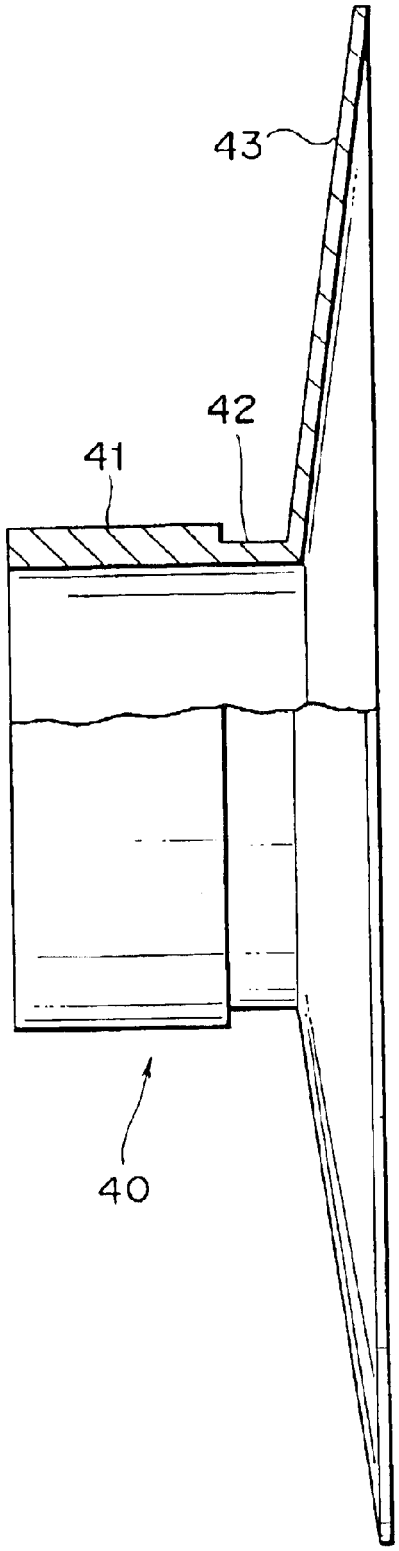
FIG. 10 is a side view, from which a portion has been removed, of another example of an inclined ring-shaped side surface light-shielding sheet of the present invention.

FIG. 10 is a side view, from which a portion has been removed, of another example of an inclined ring-shaped side surface light-shielding sheet. As shown in FIG. 10, at the inclined ring-shaped side surface light-shielding sheet, a cylindrical portion 41 and a ring-shaped sheet portion 43 are formed integrally. In the same way as the above-described flanged cylinder, a recess portion 42 is formed in the outer side surface of the cylindrical portion 41 at the ring-shaped sheet portion 43 side. The ring-shaped sheet portion 43 is preferably inclined at an angle of 5 to 20° with respect to the surface of the flange portion of the adapter which is inserted into the cylindrical portion 41.

In the light-shielded photosensitive material roll equipped with adapters which uses an inclined ring-shaped side surface light-shielding sheet, the ring-shaped light-shielding sheet is inclined toward the flange side of the adapter. Thus, even if the ring-shaped side surface light-shielding sheet is not adhered and fixed to the inner side surface of the flange portion of the adapter, the peripheral portion of the ring-shaped side surface light-shielding sheet can be accommodated in the flange recess portion. Note that it suffices for the inclined ring-shaped side surface light-shielding sheet to be inclined toward the flange of the adapter at the time when the photosensitive material sheet is unwound, and there is no need for the ring-shaped side surface light-shielding sheet to be inclined at times of non-use (i.e., at times when the photosensitive material sheet is not unwound).

Figure 11:
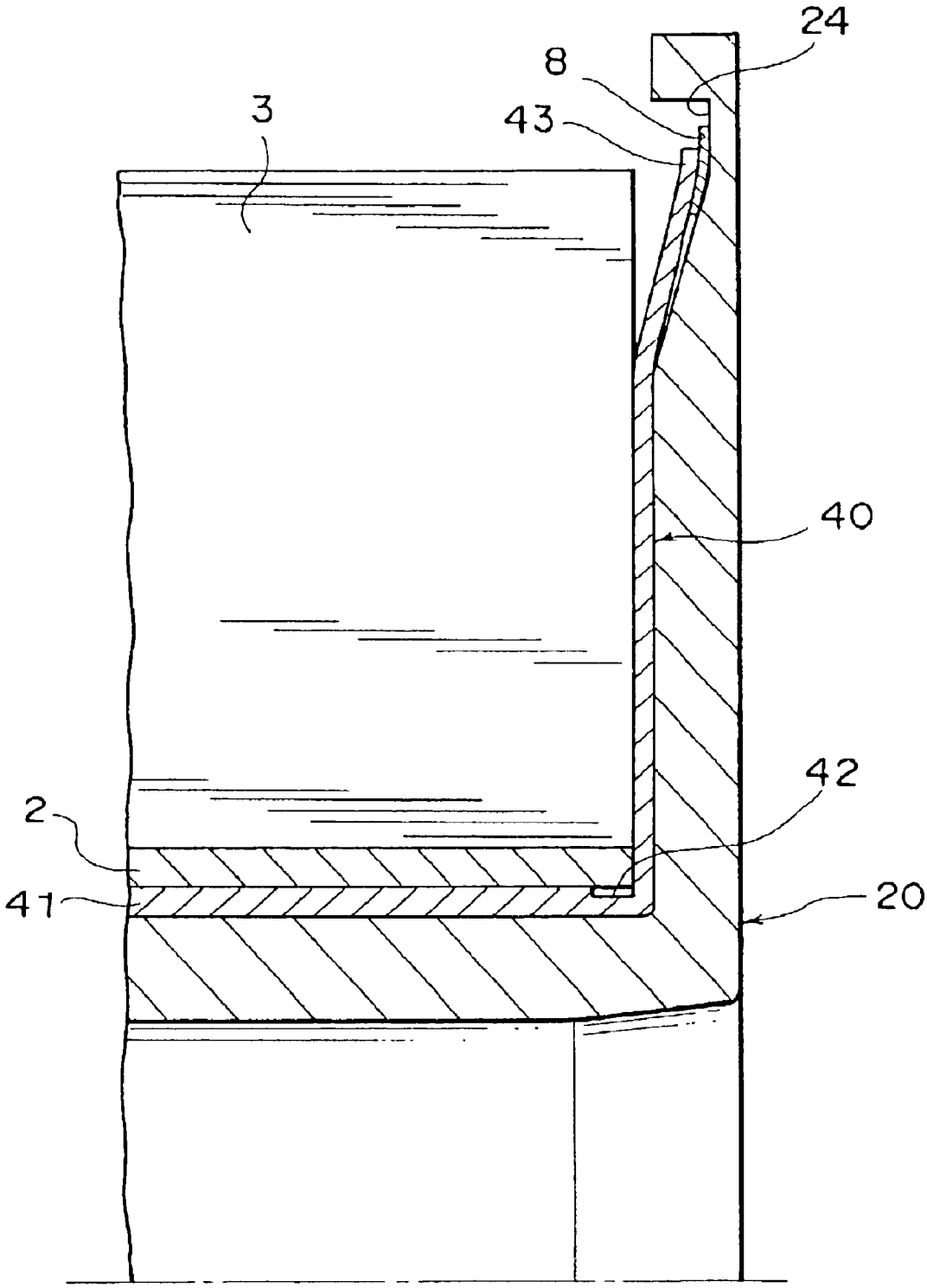
FIG. 11 is a diagram showing a state in which a portion of a photosensitive material sheet has been unwound from the light-shielded photosensitive material roll equipped with adapters, which utilizes the inclined ring-shaped side surface light-shielding sheet of FIG. 10.

FIG. 11 is a diagram showing a state in which a portion of a photosensitive material sheet has been unwound from the light-shielded photosensitive material roll equipped with adapters, which utilizes the inclined ring-shaped side surface light-shielding sheet of FIG. 10. The ring-shaped sheet portion 43 of a ring-shaped side surface light-shielding sheet 40 which is equipped with a cylindrical portion is curved along the inner side surface of the adapter flange, and the peripheral portion thereof is accommodated in the flange recess portion 24. Accordingly, in the same way as in the case of FIG. 8, in this state, even if the photosensitive material sheet 3 is wound up again on the winding core 2, it is difficult for the peripheral portion of the ring-shaped sheet portion 43 and the side end portion of the photosensitive material sheet 3 to contact one another.

In the light-shielded photosensitive material roll equipped with adapters of the present invention, it is difficult for offset in winding of the photosensitive material sheet 3 to occur at the time when the photosensitive material 3, which has been unwound once, is wound up again onto the winding core 2. Accordingly, the light-shielded photosensitive material roll equipped with adapters of the present invention can be advantageously used in various types of plate making machines.

What is claimed is:

1. A photosensitive material roll which can be mounted in a predetermined machine, comprising:

(a) a hollow, cylindrical winding core;

(b) an elongated photosensitive material sheet wound-up on the winding core;

(c) an annular member including a cylindrical portion inserted in an opening of the winding core, and a flange portion extending in a radial direction from one end of the cylindrical portion;

(d) a ring-shaped light-shielding sheet disposed between the flange portion of the annular member and the winding core; and (e) an adapter including an adapter tube portion inserted into the cylindrical portion of the annular member, and an adapter flange portion extending in a radial direction from one end of the adapter tube portion, wherein the ring-shaped light-shielding sheet is partially adhered to the adapter flange portion.

2. The photosensitive material roll of claim 1, wherein the adapter flange portion includes a ring-shaped recess which can receive an outer peripheral portion of the ring-shaped light-shielding sheet, the recess being formed at a position of the adapter flange portion which position corresponds to the outer peripheral portion of the ring-shaped light-shielding sheet.

3. The photosensitive material roll of claim 2, wherein the recess of the adapter flange portion includes an inclined surface, and the ring-shaped light-shielding sheet is adhered to the inclined surface.

4. The photosensitive material roll of claim 1, wherein the entire flange portion of the annular member is, before assembly, inclined with respect to the radial direction.

5. The photosensitive material roll of claim 1, wherein a recess portion is provided between the flange portion and the cylindrical portion of the annular member.

6. A photosensitive material roll which can be mounted in a predetermined machine, comprising:

(a) a hollow, cylindrical winding core;

(b) an elongated photosensitive material sheet wound-up on the winding core;

(c) an annular member including a cylindrical portion inserted in an opening of the winding core, and a flange portion extending in a radial direction from one end of the cylindrical portion;

(d) a ring-shaped light-shielding sheet which extends from the flange portion of the annular member and is formed as a single part with the annular member; and (e) an adapter including an adapter tube portion inserted into the cylindrical portion of the annular member, and an adapter flange portion extending in a radial direction from one end of the adapter tube portion, wherein the ring-shaped light-shielding sheet is partially adhered to the adapter flange portion.

7. A photosensitive material roll which can be mounted in a predetermined machine, comprising:

(a) a hollow, cylindrical winding core;

(b) an elongated photosensitive material sheet wound-up on the winding core;

(c) a ring-shaped light-shielding sheet including a cylindrical portion inserted in an opening of the winding core, and a ring-shaped sheet portion extending in a radial direction from one end of the cylindrical portion; and (d) an adapter including an adapter tube portion inserted into the cylindrical portion of the ring-shaped light-shielding sheet, and an adapter flange portion extending in a radial direction from one end of the adapter tube portion, wherein the adapter flange portion includes a ring-shaped recess which can receive an outer peripheral portion of the ring-shaped sheet portion of the ring-shaped light-shielding sheet, the recess being formed at a position of the adapter flange portion which position corresponds to the outer peripheral portion of the ring-shaped sheet portion.

8. The photosensitive material roll of claim 7, wherein the entire ring-shaped sheet portion is, before assembly, inclined with respect to the radial direction.

9. The photosensitive material roll of claim 7, wherein a recess portion is provided between the ring-shaped sheet portion and the cylindrical portion of the ring-shaped light-shielding sheet.

10. The photosensitive material roll of claim 7, wherein the recess of the adapter flange portion includes an inclined surface, and the ring-shaped light-shielding sheet is adhered to the inclined surface.

* * * * *